US009127397B2

(12) United States Patent
Moon et al.

(10) Patent No.: US 9,127,397 B2
(45) Date of Patent: Sep. 8, 2015

(54) WASHING MACHINE HAVING SUSPENSION MOUNTED MOTOR

(75) Inventors: Suk Yun Moon, Changwon-si (KR); Ig Geun Kwon, Changwon-si (KR); Dong Il Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 977 days.

(21) Appl. No.: 13/143,009

(22) PCT Filed: Dec. 30, 2009

(86) PCT No.: PCT/KR2009/007958

§ 371 (c)(1),
(2), (4) Date: Aug. 30, 2011

(87) PCT Pub. No.: WO2010/077088

PCT Pub. Date: Jul. 8, 2010

(65) Prior Publication Data

US 2011/0296878 A1 Dec. 8, 2011

(30) Foreign Application Priority Data

Dec. 30, 2008 (KR) ..... 10-2008-0136407

(51) Int. Cl.
*D06F 37/22* (2006.01)
*D06F 37/20* (2006.01)

(52) U.S. Cl.
CPC ..... *D06F 37/22* (2013.01); *D06F 37/206* (2013.01)

(58) Field of Classification Search
CPC ..... D06F 23/00; D06F 23/02; D06F 23/025; D06F 23/06; D06F 23/065; D06F 37/206; D06F 37/20; D06F 37/22
USPC ..... 68/140
See application file for complete search history.

(56) References Cited

U.S. PATENT DOCUMENTS

| | | | | |
|---|---|---|---|---|
| 6,122,843 | A | 9/2000 | Noguchi et al. | 34/596 |
| 2004/0083774 | A1 | 5/2004 | Kinouchi et al. | |
| 2007/0227200 | A1 * | 10/2007 | Kim et al. | 68/140 |

FOREIGN PATENT DOCUMENTS

| | | | |
|---|---|---|---|
| CN | 1464117 | A | 12/2003 |
| CN | 1509359 | A | 6/2004 |

(Continued)

OTHER PUBLICATIONS

Chinese Office Action dated Aug. 15, 2012 issued in Application No. 200980155045.3.

(Continued)

*Primary Examiner* — Michael Barr
*Assistant Examiner* — Spencer Bell
(74) *Attorney, Agent, or Firm* — Ked & Associates, LLP

(57) ABSTRACT

The present invention relates to a washing machine (100) including a cabinet (110) having a base (1.11), a tub (120) fixedly secured to an inside of the cabinet (110), a drum (130) rotatable provided in the tub (120), a rotation shaft (140) passed through the tub (120) from a rear of the drum (130), a bearing housing (150) connected to the rotation shaft (140), a suspension assembly (170) for buffering and supporting a structure connected to the bearing housing (150), a driving motor (181) provided to the suspension assembly (170) and a power transmission member (182) for transmission of the rotation force from the driving motor (181) to the rotation shaft (140), thereby permitting to increase a capacity of the washing machine (100) by changing the structure or the washing machine (100) and increase the rotation efficiency of the drum (130) by providing a driving structure which rotates the drum (130) and has an increased capacity by thus effects.

9 Claims, 4 Drawing Sheets

(56) References Cited

FOREIGN PATENT DOCUMENTS

| | | | |
|---|---|---|---|
| CN | 101046046 | A | 10/2007 |
| EP | 0 787 847 | A2 | 8/1997 |
| EP | 1 029 963 | A2 | 8/2000 |
| EP | 1 057 922 | A2 | 12/2000 |
| EP | 1 154 064 | A2 | 11/2001 |
| EP | 1 770 199 | A2 | 4/2007 |
| EP | 1 840 257 | A1 | 10/2007 |
| KR | 10-2007-0101732 | | 10/2007 |
| KR | 10-2008-0108873 | | 12/2008 |
| RU | 2174171 | C1 | 9/2001 |
| WO | WO 03/012185 | A2 | 2/2003 |

OTHER PUBLICATIONS

European Office Action dated Jul. 11, 2013 issued in Application No. 09 836 409.4.

PCT International Search Report and Written Opinion dated Oct. 15, 2010 issued in Application No. PCT/KR2009/007958.

European Search Report dated Jun. 22, 2012 issued in Application No. 09 83 6049.

Russian Office Action dated Apr. 10, 2013 issued in Application No. 2011132094.

International Search Report dated Oct. 15, 2010.

* cited by examiner

WASHING MACHINE HAVING SUSPENSION MOUNTED MOTOR

CROSS-REFERENCE TO RELATED PATENT APPLICATIONS

This application is a U.S. National Stage Application under 35 U.S.C. §371 of PCT Application No. PCT/KR2009/007958, filed Dec. 30, 2009, which claims priority to Korean Patent Application No. 10-2008-0136407, filed Dec. 30, 2008, whose entire disclosures are hereby incorporated by reference.

TECHNICAL FIELD

The present invention relates to washing machines, and more specifically, to a washing machine in which a drum rotating driving structure is improved for a tub fixed type washing machine which has an increased washing capacity.

BACKGROUND ART

In general, the washing machine is an appliance for removing various contaminants from clothes and beddings by using softening action of detergent, friction of water flow caused by rotation of a pulsator or a drum, impact applied to the laundry, and so on. Recent full automatic washing machine carries out a series of courses, such as a washing course, a rinsing course, a spinning course without intermediate user's operation.

It is recent trend that demands for drum type washing machine increases gradually, which, not only can reduce a total height compared to a pulsator type washing machine in which a washing tub rotates in an upright state, but also does not cause a problem of laundry entangling and crumpling.

The drum type washing machine is provided with a body cabinet which forms an exterior of the drum type washing machine, a tub positioned in the body cabinet supported by dampers and springs for holding washing water, and a cylindrical drum positioned in the tub for holding laundry, wherein the drum is driven by a driving unit for washing the laundry.

The drum type washing machine causes vibration inevitably due to rotation force of the drum and eccentricity of the laundry when the drum rotates for washing and spinning the laundry introduced to the drum, and the vibration generated thus is transmitted to an outside of the washing machine through the tub and the cabinet.

Consequently, in order to prevent the vibration from transmitting to the cabinet through the drum and the tub, it is essential that spring dampers are provided between the tub and the cabinet for buffering and moderating the vibration of the tub.

In the meantime, in most of cases, the drum type washing machines are installed, not individually, but according to an installation environment (for an example, a kitchen sink arrangement, or a built-in environment). Therefore, it is required that a size of the drum type washing machine is defined according to an installation environment.

Thus, in a case of the drum type washing machine, change of an inside structure thereof is limited by the springs and the damper structures between the tub and the cabinet provided for moderating the vibration, and as the washing machine installation environment is limited, the size change of the washing machine is also limited.

In the meantime, recently, in order to increase a washing capacity and provide user's convenience, there are many researches undergoing for increasing the washing capacity of the washing machine. However, due to above limiting condition, there is many difficulties for increasing a size of the tub for increasing the washing capacity within a related art drum type washing machine structure.

Accordingly, there are a variety of structures of washing machines under developing for increasing the washing capacity.

DISCLOSURE OF INVENTION

Technical Problem

To solve the problems, an object of the present invention is to provide a washing machine which can increase capacities of a tub and a drum in a state an external size of a related art drum type washing machine is maintained, and having a driving structure for making effective rotation of the drum of which size is increased thus.

Technical Solution

To achieve these objects and other advantages and in accordance with the purpose of the invention, as embodied and broadly described herein, a washing machine includes a tub provided in a fixed state, a drum rotatably provided in the tub, a rotation shaft passed through the tub from a rear of the drum, a driving motor for generating power for rotating the driving motor, and a power transmission member for transmission of rotating force from the driving motor to the rotation shaft.

Preferably, the driving motor and the power transmission member vibrate together with vibration of the drum.

Preferably, the power transmission member includes a driving pulley mounted to the driving motor, a driven pulley mounted to the rotation shaft, and a belt for transmission of rotation of the driving pulley to the driven pulley.

Preferably, the washing machine further includes a bearing housing for rotatably supporting the rotation shaft connected to the drum, and a suspension assembly connected to the bearing housing for buffering and supporting vibration of the drum.

Preferably, the suspension assembly includes first and second vertical brackets extended down from the bearing housing respectively, first and second horizontal brackets extended forward from the first and second vertical brackets respectively, and a plurality of dampers for buffering and supporting the first and second horizontal brackets.

Preferably, the driving motor is positioned between the first vertical bracket and the first horizontal bracket.

Preferably, the first and second vertical brackets and the first and second horizontal brackets are provided in symmetry in which the first and second vertical brackets and the first and second horizontal brackets are extended downward outwardly from a center of the tub.

Preferably, the driving motor serves as a balance weight of the drum.

In another aspect of the present invention, a washing machine includes a cabinet having a base, a tub fixedly secured to an inside of the cabinet, a drum rotatably provided in the tub, a rotation shaft passed through the tub from a rear of the drum, a bearing housing connected to the rotation shaft, a suspension assembly for buffering and supporting a structure connected to the bearing housing, a driving motor provided to the suspension assembly, and a power transmission member for transmission of rotation force from the driving motor to the rotation shaft.

Preferably, the suspension assembly includes first and second vertical brackets extended down from the bearing housing respectively, and first and second horizontal brackets extended forward from the first and second vertical brackets respectively, and the driving motor is positioned between the first vertical bracket and the first horizontal bracket.

Preferably, the first and second vertical brackets are provided in symmetry in which the first and second vertical brackets are extended downward outwardly from a center of the tub.

Preferably, the driving motor serves as a balance weight of the drum.

Preferably, the power transmission member includes a driving pulley mounted to the rotation shaft of the driving motor, a driven pulley mounted to the rotation shaft, and a belt for transmission of rotation of the driving pulley to the driven pulley.

In the laundry machine, the tub may be fixedly supported, or be supported by a flexible support structure, such as the suspension unit.

Further, the tub may be supported in an interim state between the fixed support and the flexible support.

That is, the tub may be flexibly supported by the suspension unit or be rigidly supported. For example, the tub may be supported by the suspensions, be supported by rubber bushings to provide less flexible movement than when supported by the suspensions, or be fixedly supported by being fixed somewhere by screws or so.

For another instance, the cases where the tub is supported more rigidly than when supported by the suspension unit are as follows.

Firstly, the tub may be made integrally with the cabinet.

Next, the tub may be supported by being fastened by screws, rivets, rubber bushings, etc. Also, the tub may be welded or bonded to the cabinet. In this case, the supporting or fastening members have larger stiffnesses than a stiffness of the suspension unit with respect to the main direction of the vibration of the drum.

The tub may be expanded within the limits of a space in which the tub is placed. That is, the tub may be expanded until the circumferential surface thereof reaches (or almost reaches) a side wall or a side frame (for example, a left or right plate of a cabinet) restricting the size of the space at least in the lateral direction (the direction laterally perpendicular to the axial direction of the rotary shaft when the rotary shaft is horizontally placed). The tub may be made integrally with the lateral side walls of the cabinet.

The tub may be formed to be closer in the lateral direction to the wall or the frame than the drum. For example, the tub may be spaced away from the wall or the frame by an interval of less than 1.5 times an interval with the drum. Under the condition that the tub is enlarged in the lateral direction, the drum may also be enlarged in the lateral direction. Further, if the lateral interval between the tub and drum is reduced, the drum may be expanded in the lateral direction in direct proportion. When the lateral interval between the tub and the drum is reduced, the vibration of the drum in the lateral direction may be considered. The weaker the vibration of the drum in the lateral direction, the more expanded is the diameter of the drum. Therefore, the suspension unit to reduce the vibration of the drum may be designed such that rigidity of the suspension unit in the lateral direction is greater than rigidities of the suspension unit in other directions. For example, the suspension unit may be designed such that rigidity of the suspension unit against displacement in the lateral direction is greatest compared with rigidities of the suspension unit against displacements in other directions.

Further, the suspension unit may be directly connected to the bearing housing supporting the rotary shaft. That is, the bearing housing comprises a supporting portion to rotatably support the shaft and an extended portion extended from the supporting portion, and the suspension unit is attached to the supporting portion of the bearing housing or the extended portion of the bearing housing.

The suspension unit may include brackets extended in the axial direction. In a front loading type laundry machine, the brackets may be extended forward, namely towards a door.

The suspension unit may comprises at least two suspensions which are arranged distant from each other in the axial direction of the shaft.

The suspension unit may comprise suspensions placed below the shaft for standing support. The supported object (for example, the drum) is supported by the suspensions to stand alone.

Alternately, the suspension unit may comprise suspensions placed over the shaft for hanging support. In this case, the supported object is supported to be hung.

The mass center of the vibrating object (for example, a combination of the drum, the shaft, the bearing housing, and the motor) may be located, with respect to the center of the longitudinal length of the drum, at a side where the motor is located. In a front loading type laundry machine, the mass center may be located behind the longitudinal center of the drum. In this case, at least one suspension may be placed in front of or behind the mass center. One suspension may be placed in front of the mass center and another suspension behind the mass center.

The tub may be provided with an opening at a rear portion thereof. The drive assembly may be connected to the tub by a flexible member. The flexible member may seal between the tub and the drive assembly to prevent water from leaking through the opening of the rear portion of the tub, and allow the drive assembly to move relatively to the tub. The flexible member may be made of a flexible material which can do the sealing, for example, a gasket material like a front gasket. In this case, the flexible member may be referred to as a rear gasket for convenience. The rear gasket may be connected to the drive assembly under the condition that the rotation of the rear gasket at least in the rotational direction of the rotary shaft is constrained. In one embodiment, the flexible material may be directly connected to the shaft. In another embodiment, the flexible material may be connected to a portion of the bearing housing.

Further, a portion of the drive assembly, which is located radially inside the rear gasket and thus is likely to be exposed to the water in the tub, may be made so as no to be corroded by the water. For example, the portion of the drive assembly may be coated, or be surrounded with a separate member made of plastic such as the tub back (which will be described below). In a case where the portion of the drive assembly is made of metal, the portion may not be directly exposed to water by the coating or the separate plastic member, and thus corrosion of the portion may be prevented.

Further, the cabinet may not be necessary. For example, in a built-in laundry machine, the laundry machine without the cabinet may be installed within a space of a wall structure. However, even in this case, a front plate forming the front face of the laundry machine may be required.

Advantageous Effects

The present invention has following advantageous effects.

By changing a structure of the washing machine, a capacity of the washing machine can be increased.

Moreover, by providing a driving structure that can rotate the drum having a capacity increased thus effectively, a rotation efficiency of the drum can be improved.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

In describing the present invention, names of elements of the washing machine are given taking functions thereof into account. Therefore, the names should not be understood that the name defines the element technically. Moreover, the names given to the elements can be called in other names in this field of art.

Figure 1:
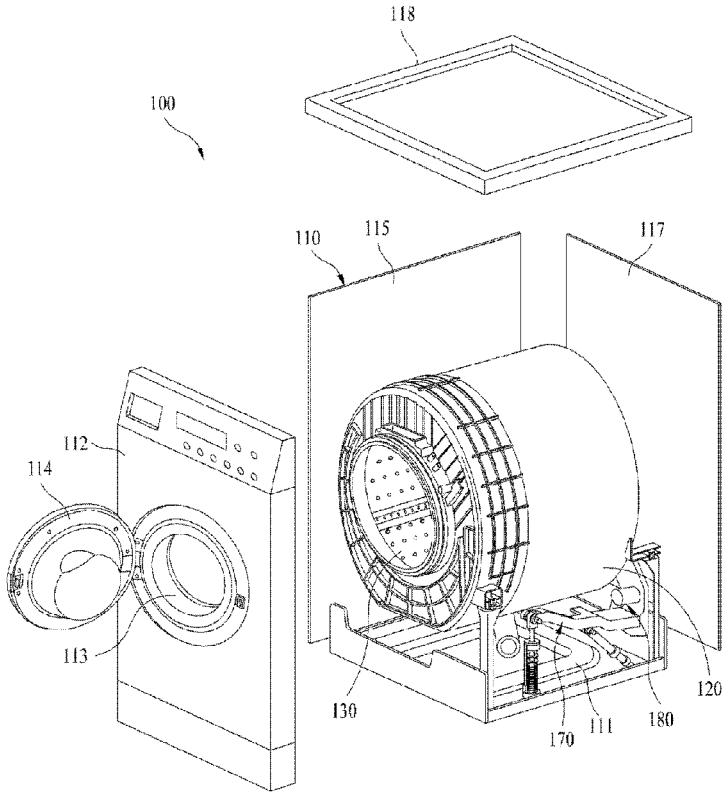
FIG. 1 illustrates a perspective view of a washing machine in accordance with a preferred embodiment of the present invention, schematically.
Figure 2:
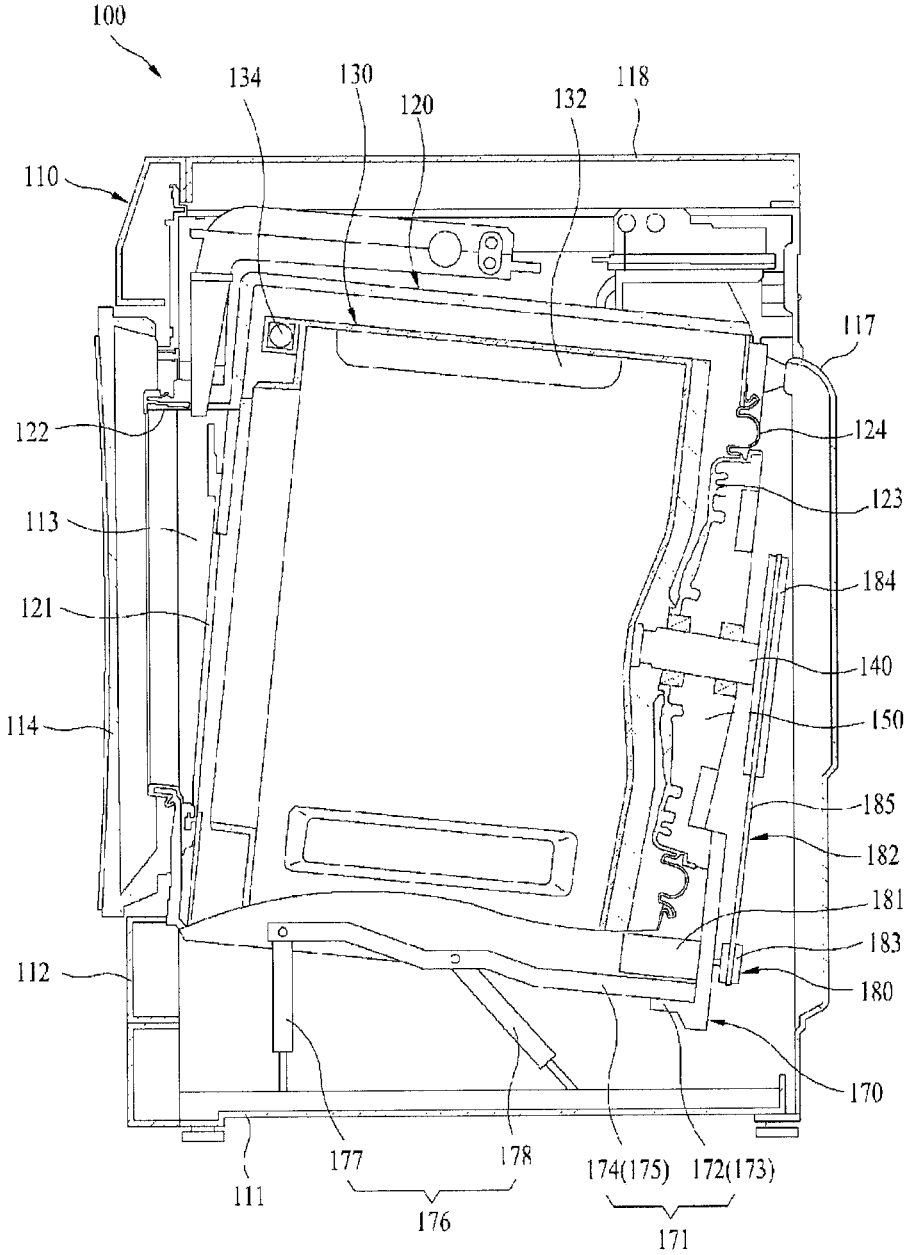
FIG. 2 illustrates a longitudinal section of a washing machine in accordance with a preferred embodiment of the present invention.

FIG. 1 illustrates a perspective view of a washing machine in accordance with a preferred embodiment of the present invention schematically, and FIG. 2 illustrates a longitudinal section of a washing machine in accordance with a preferred embodiment of the present invention.

Referring to FIGS. 1 and 2, the washing machine 100 includes a cabinet 110 which forms an exterior of the washing machine 100, a tub 120 fixedly secured to an inside of the cabinet 110, a drum 130 rotatably positioned in the tub 120, a rotation shaft 140 passed through a rear of the tub 120 and connected to the drum 130, a bearing housing 150 for supporting the rotation shaft 140, a driving unit 180 connected to the rotation shaft 140 for transmission of rotation force, and a suspension assembly 170 coupled to the bearing housing 150 for supporting, and buffering vibration and impact from, structures connected to the bearing housing 150.

The cabinet 110 includes a base 111 for seating and supporting various components of the washing machine, and a front panel 112 having a laundry opening 113 formed therein. In addition to this, the cabinet includes left/right side panels 115 (not shown), a rear panel 117 and a top panel 118. a door 114 is provided to the laundry opening 113 in the front panel 112 for opening/closing the laundry opening 113.

The tub 120 is fastened to the inside of the cabinet 110 with additional fasteners (for an example, screws, bolts and the like). For an example, the tub 120 is fastened to the front panel 112, the rear panel 117 and/or left/right side panels 115 (not shown) with the fasteners and supporting members (not shown).

The tub 120 has an opening 121 in a front thereof adjacent to the door 114 for introduction of the laundry. There is a front gasket 122 between the opening 121 and the laundry opening 113 for sealing a gap therebetween. In a rear of the tub 120, there is a tub back wall 123 for placing the rotation shaft 140 therein. The tub back wall 123 is movably coupled by an annular rear gasket 124 in a rear of the tub 120.

The drum 130 is rotatably provided in the tub 120, has a rear end coupled to the rotation shaft 140. on an inside surface of the drum 130, there are lifts 132 for moving the laundry. Along with this, at the front and rear of the drum 130, there are weight balancers 134 for balancing the drum 130 to suppress vibration of the drum 130.

The bearing housing 150 is coupled to the tub back wall 123 at the rear of the tub 120. Through an inside of the bearing housing 150, the rotation shaft 140 coupled to the drum 130 passes. The bearing housing 150 has bearings (not shown) mounted thereto for smooth rotation of the rotation shaft 140, and the rotation shaft 140 is supported on the bearings.

The suspension assembly 170 includes a damper bracket 171 coupled to the bearing housing 150, and a damper unit 176 coupled to the damper bracket 171 for buffering the vibration and impact transmitted to the damper bracket 171.

The damper bracket 171 includes one pair of first and second vertical brackets 172 and 173 extended downward from an outside of the bearing housing 150 respectively, and first and second horizontal brackets 174 and 175 coupled to ends of the first and second vertical brackets 172 and 173 and extended toward the front to the tub 120, respectively.

In this instance, it is preferable that the first and second vertical brackets 172 and 173 are symmetric with reference to a center of the bearing housing in left/right directions. The first and second vertical brackets 172 and 173 are extended downward from the center of the bearing housing 150 in a radial direction.

The damper unit 176 is mounted between base 111 and the first and second horizontal brackets 174 and 175 for supporting the first and second horizontal brackets 174 and 175. The damper unit 176 includes spring dampers 177 for supporting the first and second horizontal brackets 174 and 175 and damping and absorbing vertical displacement respectively, and oil dampers 178 for damping horizontal displacement of the first and second horizontal brackets 174 and 175, respectively.

In this instance, one pair of the spring dampers 177 are vertically mounted between the base 111 and ends of the first and second horizontal brackets 174 and 175 respectively, and one additional spring damper is positioned between the bearing housing 150 and the base 111 for supporting the bearing housing 150. The spring dampers 177 suspend the drum 130 in the tub 120, and buffer and damp vertical vibration taking place when the drum 130 rotates.

The oil dampers 178 are mounted between centers of the first and second horizontal brackets 174 and 175 and the base 111 respectively and tilted downward parallel to a rotation shaft of the drum 130. The oil dampers 178 dampen horizontal vibration taking place when the drum 130 rotates.

The driving unit 180 is connected to the rotation shaft 140 which is passed through and supported by the bearing housing 150 for transmission of power for rotating the rotation shaft 140. The driving unit 180 includes a driving motor 181 for generating the power, and a power transmission member 182 for transmission of the power from the driving motor 181 to the rotation shaft 140.

The driving unit 180 will be described with reference to the attached drawings.

Figure 3:
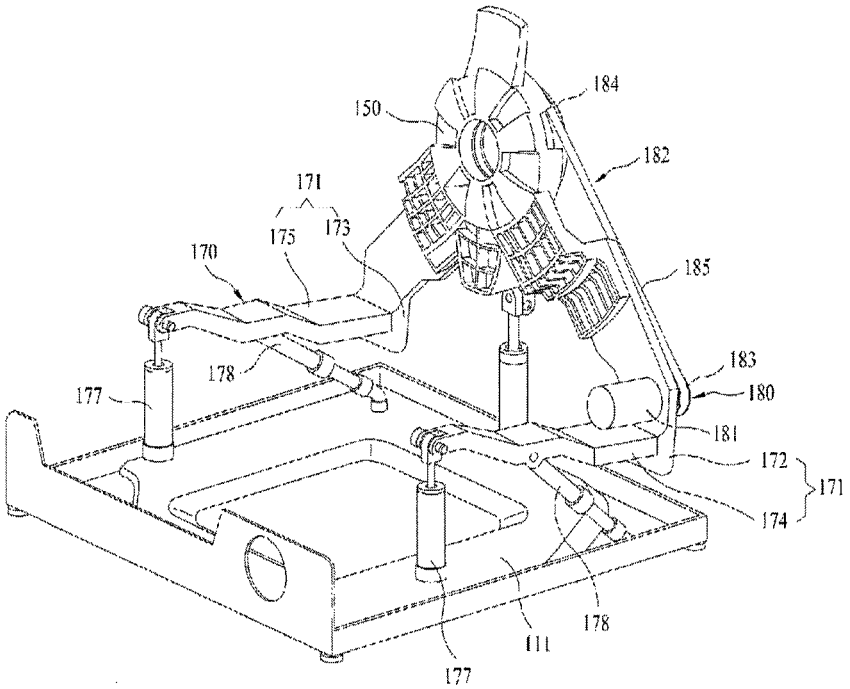
FIG. 3 illustrates a perspective view of a driving unit of a washing machine in accordance with a preferred embodiment of the present invention.
Figure 4:
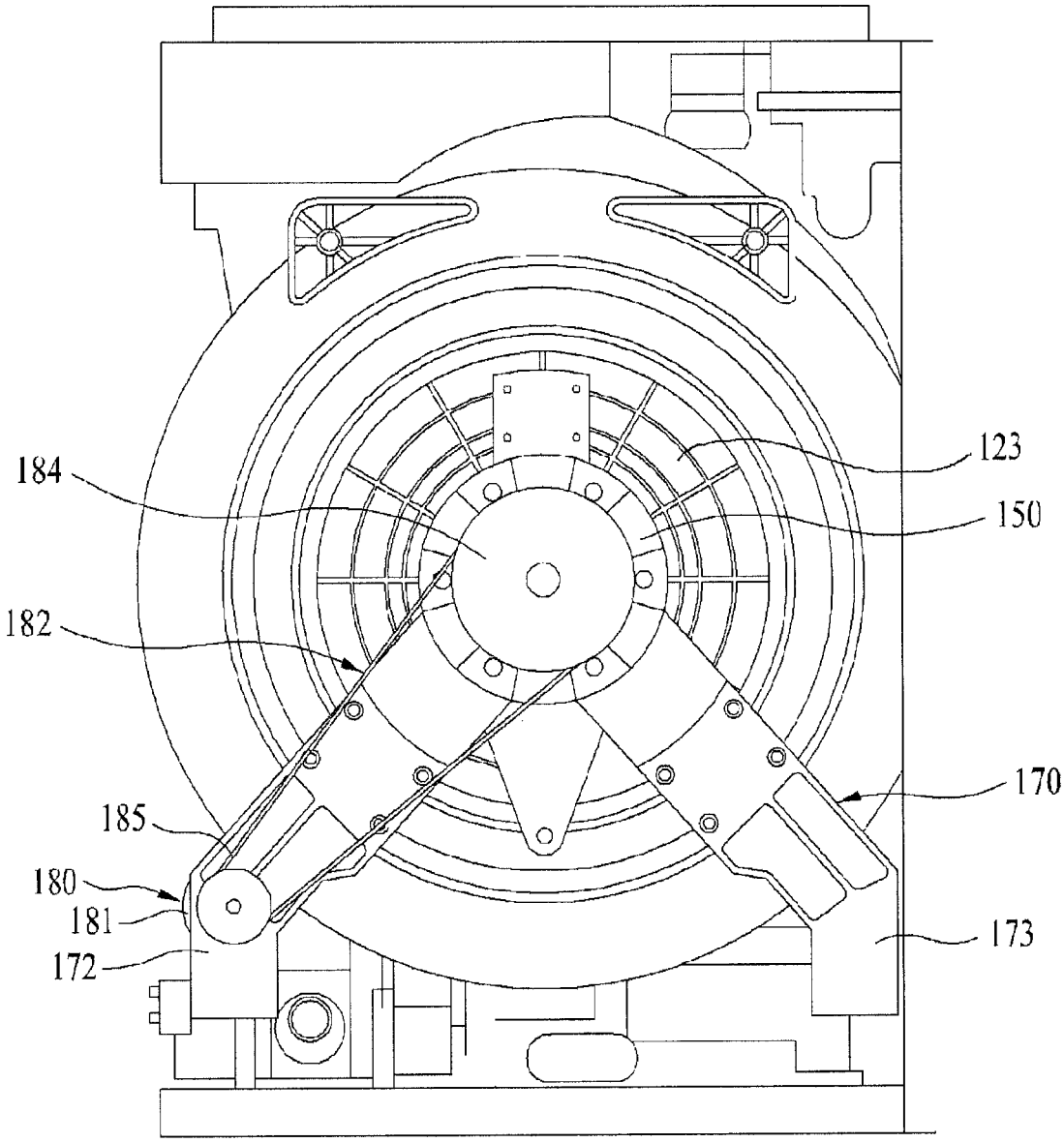
FIG. 4 illustrates a back side view of a driving unit of a washing machine in accordance with a preferred embodiment of the present invention.

FIG. 3 illustrates a perspective view of a driving unit of a washing machine in accordance with a preferred embodiment of the present invention, and FIG. 4 illustrates a back side view of a driving unit of a washing machine in accordance with a preferred embodiment of the present invention.

Referring to FIGS. 3 and 4, the driving motor 181 of the driving unit 180 is mounted in a space between the first vertical bracket 172 (or the second vertical bracket 173) and the first horizontal bracket 174 (or the second horizontal bracket 175).

The driving motor 181 is provided to have a speed thereof controlled by a control unit (not shown). Since structure and kind of the driving motor are known widely to persons skilled in this art of field, detailed description of the driving motor 181 will be omitted.

In addition to this, in view of structure, the suspension assembly 170 is mounted to support the rear of the drum 130, making the drum 130 to be tilted forward by gravity. Accordingly, the driving motor 181, mounted in rear of the drum 130, serves as a balance weight of the drum 130, preventing the drum 130 from tilting forward downwardly.

The power transmission member 182 transmits the rotating force from the driving motor 181 to the rotation shaft 140. The power transmission member 182 includes a driving pulley 183 at the driving motor 181, a driven pulley 184, and a belt 185 connecting the driving pulley 183 to the driven pulley 184.

According to the washing machine of the embodiment, since the tub 120 is fixedly secured to the cabinet 110 not to permit shaking of the tub 120, a diameter of the tub 120 can be made greater, permitting volumes of the tub 120 and the drum 130, substantially.

Moreover, since the tub 120 is fixedly secured to the cabinet 110, if vibration or impact is transmitted to the tub 120 assembled as one unit with the cabinet 110, not only the tub 120 itself is shaken by the vibration or impact, but also an effect can be expected, in which rigidity of the tub 120 is increased and a whole vibration characteristic of the drum type washing machine can be improved, owing to addition of the gravity of the cabinet 110 to the tub 120.

Furthermore, the one side supporting of the drum 130 that rotates increases an inside volume of the drum 130 further compared to a type in which the drum 130 is supported on opposite ends, reducing a number of components as many, permitting to expect improvement of productivity.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A washing machine comprising:

a tub to hold water therein;

a drum rotatably provided in the tub;

a rotation shaft passed through the tub from a rear of the drum;

a bearing housing for rotatably supporting the rotation shaft connected to the drum;

a suspension assembly connected to the bearing housing for buffering and supporting vibration of the drum;

a driving motor coupled to the suspension assembly; and a power transmission assembly configured to transmit rotating force from the driving motor to the rotation shaft, the power transmission assembly including a driving pulley mounted to the driving motor, a driven pulley mounted to the rotation shaft, and a belt for transmission of rotation of the driving pulley to the driven pulley, wherein the suspension assembly includes brackets extending from the bearing housing and dampers supporting the brackets, wherein the brackets include first and second radius-direction brackets extending from a lower portion of the bearing housing in a radial direction, and first and second axis-direction brackets respectively connected to the first and second radius-direction brackets and extending to a front side of the tub, and wherein the driving motor is mounted on one of the first radius-direction bracket and the second radius direction bracket to send power to the power transmission assembly.

2. The washing machine as claimed in claim 1, wherein the driving motor and the power transmission assembly vibrate together with vibration of the drum.

3. The washing machine as claimed in claim 2, wherein the driving motor serves as a balance weight of the drum.

4. The washing machine as claimed in claim 1, wherein the driving motor is positioned near where the first radius-direction bracket and the first axis-direction bracket are connected to each other.

5. The washing machine as claimed in claim 1, wherein the first and second radius-direction brackets are provided in symmetry in which the first and second radius-direction brackets are extended downward outwardly from a center of the tub.

6. The washing machine of claim 5, wherein the first and second axis-direction brackets are provided in symmetry.

7. The washing machine of claim 1, wherein the driving motor is supported by the suspension assembly.

8. The washing machine of claim 1, wherein the driving motor is supported on the first radius-direction bracket.

9. The washing machine of claim 8, wherein the driving motor is provided on a first side of the first radius-direction bracket, and the power transmission assembly is provided on a second side of the first radius-direction bracket, where first and second sides are opposite sides.

* * * * *